United States Patent [19]

Ishikawa et al.

[11] Patent Number: 4,948,710

[45] Date of Patent: Aug. 14, 1990

[54] METHOD OF PROCESSING SILVER HALIDE COLOR PHOTOGRAPHIC LIGHT-SENSITIVE MATERIALS

[75] Inventors: Takatoshi Ishikawa; Shinzo Kishimoto, both of Kanagawa, Japan

[73] Assignee: Fuji Photo Film Co., Ltd., Kanagawa, Japan

[21] Appl. No.: 380,759

[22] Filed: Jul. 17, 1989

Related U.S. Application Data

[63] Continuation of Ser. No. 5,307, Jan. 20, 1987, abandoned, which is a continuation of Ser. No. 748,880, Jun. 26, 1985, abandoned.

[30] Foreign Application Priority Data

Jun. 26, 1984 [JP] Japan ..... 59-131508

[51] Int. Cl.[5] ..... G03C 5/38; G03C 7/42

[52] U.S. Cl. ..... 430/372; 430/428; 430/429; 430/432; 430/463; 430/393; 430/491

[58] Field of Search ..... 430/372, 428, 429, 432, 430/463, 488, 491, 393

[56] References Cited

U.S. PATENT DOCUMENTS

| | | | |
|---|---|---|---|
| 3,201,246 | 8/1965 | Allen et al. | 430/491 |
| 4,537,856 | 8/1985 | Kurematsu et al. | 430/432 |
| 4,562,144 | 12/1985 | Kurematsu et al. | 430/463 |
| 4,618,569 | 10/1986 | Kurematsu et al. | 430/372 |
| 4,623,613 | 11/1986 | Ishikawa et al. | 430/372 |
| 4,775,612 | 10/1988 | Abe et al. | 430/393 |

FOREIGN PATENT DOCUMENTS

| | | |
|---|---|---|
| 0132146 | 2/1981 | Japan . |
| 0018631 | 7/1981 | Japan . |

*Primary Examiner*—Richard L. Schilling

*Attorney, Agent, or Firm*—Sughrue, Mion, Zinn, Macpeak & Seas

[57] ABSTRACT

A method of continuously processing an imagewise exposed silver halide color photographic light-sensitive material is described, in which subsequent to a bleach-fixing step or bleaching and fixing steps the material is washed in a water washing step in the presense of at least one compound represented by general formula (I):

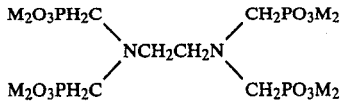

(I)

wherein M is a hydrogen atom, a lithium atom, a sodium atom, a potassium atom or an ammonium ion and each M may be the same or different.

This method permits great reduction of the amount of water used in the washing step in the processing of silver halide color photographic light-sensitive materials.

6 Claims, No Drawings

METHOD OF PROCESSING SILVER HALIDE COLOR PHOTOGRAPHIC LIGHT-SENSITIVE MATERIALS

This is a continuation of application Ser. No. 005,307 filed Jan. 20, 1987, which is a continuation of application Ser. No. 748,880 filed June 26, 1985, now abandoned.

FIELD OF THE INVENTION

The present invention relates to an improved method of processing silver halide color photographic light-sensitive materials and, more particularly, to a processing method which permits great reduction of the amount of water to be used in the washing step.

BACKGROUND OF THE INVENTION

As is well known, the processing of silver halide photographic light-sensitive materials typically includes a washing step. It is desirable to reduce the amount of water for the washing step to protect the environment, to conserve water resources, or to reduce processing costs. For this purpose, S. R. Goldwasser, "*Water Flow Rates in Immersion -Washing of Motion Picture Film*", SMPTE, 64, pp. 248–253 (May, 1955), for example, discloses a method of reducing the amount of water in the washing step, in which a plurality of washing tanks are used and water is flowed countercurrently. This method is now employed as an effective means in various types of automatic developing machines. This method has the disadvantages that the washing water contaminated during the processing with iron ions from the bleaching step and thiosulfates from the fixing step is very unstable. Furthermore, if the amount of the washing water is greatly decreased, the resident time of the washing water is undesirably lengthened, and various precipitates and floating matter are formed. These precipitates and floating matter can attach to the light-sensitive material, thereby contaminating it, or cause other difficulties such as plugging or contaminating a filter of the automatic developing machine.

In order to overcome the above problems, various techniques to prevent precipitates from forming in the washing water have been proposed. For example, L. E. West, "*Water Quality Criteria*", *Phot. Sci. and Eng.*, Vol. 9, No. 6 (1965), discloses the addition of chelating agents and biocides.

In addition, Japanese Patent Application (OPI) Nos. 8542/82, 105145/83 and 157244/82 (the term "OPI" as used herein refers to a "published unexamined Japanese patent application open to public inspection") describe the addition of various biocides. These compounds, however, are poor in solubility, or unsuitable from a viewpoint of safety, or have an insufficient effect of preventing precipitation, and thus fail to provide satisfactory results. Incorporation of chelating agents is described in Japanese Patent Application (OPI) Nos. 8542/82, 58143/82, 132146/82 and 18631/83. These chelating agents, however, are insufficient in preventing precipitation, or exert adverse influences on the image stability, and consequently also fail to provide satisfactory results. In addition, a method of adding sulfites and chelating agents in combination is described in Japanese Patent Application (OPI) Nos. 97530/82, 88738/84 and 88739/84. These combinations, however, are also unsatisfactory for the efficient prevention of precipitation.

SUMMARY OF THE INVENTION

An object of the present invention is to greatly reduce the amount of water used in the washing step in the processing of silver halide color photographic light-sensitive materials.

Another object of the present invention is to greatly stabilize the washing water without causing problems such as a reduction in the image stability, for the purpose of reducing the amount of water to be used in the washing step.

It has been found that these and other objects of the present invention can be attained by a method of continuously processing an imagewise exposed silver halide color photographic light-sensitive material comprising the steps of (a) developing the exposed material, (b) bleaching and fixing the developed material or bleach-fixing the material, and then (c) washing the material with water in the presence of at least one compound represented by the general formula (I):

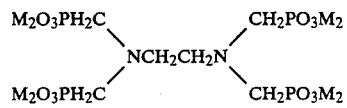

(I)

wherein M is a hydrogen atom, a lithium atom, a sodium atom, a potassium atom, or an ammonium ion, and each M may be the same or different.

DETAILED DESCRIPTION OF THE INVENTION

As a result of extensive studies on the mechanism of precipitation in washing water containing both iron ions and thiosulfate ions, although not desiring to be bound by theory the inventors consider that the formation of precipitates is caused mainly by two factors: first, precipitation of decomposition of thiosulfate through aerial oxidation of the sulfate with the iron ion as a catalyst, second, precipitation of the iron complexes by the action of the iron bacteria, and third, prevention of decomposition of the thiosulfate by the action of the sulfur bacteria. Thus, it has been found that the stability of the washing water can be increased by properly shielding the iron ion in the washing water. Based on the above findings, various chelating agents were investigated and, as a result, it has been found that the compounds of the general formula (I) specifically improve the stabilization of the washing water due to the iron ion shielding and biocide function thereof.

Typical examples of the compounds of the general formula (I) are shown below, although the present invention is not to be construed as being limited thereto.

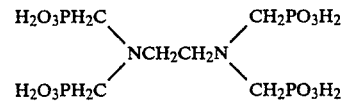

I-1

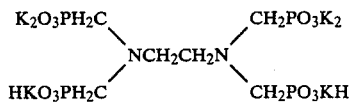

I-2

-continued

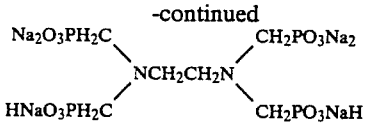

I-3

The amount of the compound of general formula (I) present is preferably from about $1\times10^{-5}$ to 1.0 mol, more preferably from about $1\times10^{-4}$ to $2\times10^{-2}$ mol, per liter of the washing water.

During continuous processing or development, the washing water is inevitably contaminated with the iron salt used as a bleaching component and the thiosulfate used as a fixing component from the preceding baths (i.e., bleaching and fixing, or bleach-fixing baths). The concentrations of the iron salt and thiosulfate vary depending on the washing method; typically, however, the iron content is from about $1\times10^{-6}$ to $1\times10^{-1}$ mol/l and preferably from about $1\times10^{-5}$ to $5\times10^{-2}$ mol/l, and the thiosulfate content is from about $1\times10^{-4}$ to $5\times10^{-1}$ mol/l and preferably from about $1\times10^{-3}$ to $3\times10^{-}$mol/l.

As well as the compound of the general formula (I), various compounds may be added to the washing water of the present invention. For example, as biocides, thiazolylbenzimidazole compounds described in Japanese Patent Application (OPI) Nos. 157244/82 and 105145/83, isothiazolone compounds described in Japanese Patent Application (OPI) No. 8542/82, chlorophenol compounds exemplified by trichlorophenol, bromophenol compounds, organic tin or organic zinc compounds, thiocyanic acid or isocyanic acid compounds, acid amide compounds, diazine and triazine compounds, thiourea compounds, alkylguanidine compounds, quaternary ammonium salts exemplified by benzammonium chloride, antibiotics exemplified by penicillin, and usual biocides may be used in combination. It is particularly preferred for the compound of general formula (I) to be used in combination with thiazolylbenzimidazole compounds or isothiazolone compounds.

In addition, if desired, hardening agents exemplified by magnesium and aluminum salts, surface active agents to prevent load and unevenness in drying, brightening agents to increase the degree of whiteness, sulfites as preservatives, bismuth salts to accelerate chelating with iron, and so forth can be added. Compounds as described in L. E. West, "*Water Quality Criteria*", *Phot. Sci. and Eng.*, Vol. 9, No. 6, page 398 (1965), for example, may also be added.

In the present invention, washing is preferably carried out by a countercurrent washing process utilizing 2 to 5 vessels since the amount of water used in the washing process is reduced. In this case, the necessary amount of water for the washing process is about 50 to 100 ml per square meter of the color photographic light-sensitive material. The exact amount of the washing water varies also with the number of washing tanks; it can be calculated by referring to S. R. Goldwasser,'-'*Water Flow Rates in Immersion -Washing of Motion Picture Film*", SMPTE, 64, pp. 248–253 (May, 1955).

The compounds of the general formula (I) are added to every tank in the case of using the countercurrent washing process utilizing a multiple washing tank.

The washing water to be used in the present invention generally has a pH of about 7. In some cases, however, the pH may range between about 3 and 9 by the presence of compounds brought from the pre-bath. The washing temperature is from about 5 to 40° C. and preferably from about 10° to 35° C. If necessary, a heater, a temperature controller, a circulation pump, a filter, a floating cover, a squeege, and so forth may be provided inside the washing vessel.

The method of the present invention can be applied to any of ordinary silver halide color photographic light-sensitive materials such as a color negative film, a color paper, a color positive film, and a color reversal film. Particularly preferably it is applied to the processing of color papers and color negative films.

Typical development processing sequences of the method of the present invention are shown below, although the present method is not limited thereto.

A: Color development→bleach-fixing→washing→drying

B: Color development→bleach-fixing→washing→stabilization→drying

C: Color development→washing→bleach-fixing→washing→drying

D: Color development→bleaching→fixing→washing→stabilization→drying

E: Color development→bleaching→fixing→washing→drying

F: Color development→washing→bleaching→fixing→washing→drying

The color developer to be used in the method of the present invention contains a color developing agent. Preferred examples of such color developing agents are p-phenylenediamine derivatives, and typical examples of such p-phenylenediamine derivatives are shown below although the present invention is not limited thereto.

D-1: N,N-Diethyl-p-phenylenediamine

D-2: 2-Amino-5-diethylaminotoluene

D-3: 2-Amino-5-(N-ethyl-N-laurylamino)toluene

D-4: 4-[N-Ethyl-N-(β-hydroxyethyl)amino]aniline

D-5: 2-Methyl-4-[N-ethyl-N-(β-hydroxyethyl)amino]-aniline

D-6: N-Ethyl-N-(β-methanesulfonamidoethyl)-3-methyl-4-aminoaniline

D-7: N-(2-Amino-5-diethylaminophenylethyl)methanesulfonamide

D-8: N,N-Dimethyl-p-phenylenediamine

D-9: 4-Amino-3-methyl-N-ethyl-N-ethoxyethylaniline

D-10: 4-Amino-3-methyl-N-ethyl-N-β-ethoxyethylaniline

D-11: 4-Amino-3-methyl-N-ethyl-N-β-butoxyethylaniline

These p-phenylenediamine derivatives may be in the form of salts such as sulfates, hydrochlorates, sulfites and p-toluenesulfonates. The above compounds are described in, for example, U.S. Pat. Nos. 2,193,015, 2,552,241, 2,566,271, 2,592,364, 3,656,950 and 3,698,525. The amount of the aromatic primary amine developing agent being used is from about 0.1 to 20 g, preferably from about 0.5 to 10 g per liter of the developer.

The color developer which is used in the present invention may contain hydroxylamines conventional in color developers.

These hydroxylamines can be used in the form of free amines in the color developer. In general, however, they are used in the form of water-soluble acid salts such as sulfates, oxalates, hydrochlorates, phosphates, carbonates, and acetates. The hydroxylamines may be unsubstituted or substituted with an alkyl group in the nitrogen atom thereof.

The pH of the color developer that is used in the present invention is preferably from about 9 to 12 and more preferably from about 9 to 11.

In addition, the color developer may contain other known components. For example, as alkali agents and pH buffers, caustic soda, caustic potash, sodium carbonate, potassium carbonate, sodium tertiary phosphate, potassium tertiary phosphate, potassium metaphosphate, and borax can be used alone or in combination with each other. In order to provide a buffering capability, or for convenience of preparation, or for the purpose of increasing ionic strength, disodium or dipotassium hydrogen phosphate, sodium or potassium dihydrogen phosphate, sodium or potassium bicarbonate, boric acid, alkali nitrate, and alkali sulfate can be added.

The color developer may further contain various chelating agents for the purpose of preventing the precipitation of calcium or magnesium. Typical examples of such chelating agents are polyphosphoric acid salts, aminopolycarboxylic acids, phosphonocarboxylic acids, aminopolysulfonic acids, 1-hydroxyalkylidene-1,1-diphosphonic acid and the like.

The color developer may further contain development accelerators. For example, pyridinium compounds and other cationic compounds, cationic dyes such as phenosafranine, and neutral salts such as thallium nitrate and potassium nitrate as described in U.S. Pat. Nos.2,648,604, 3,171,247, and Japanese Patent Publication No. 9503/69, nonionic compounds such as polyethylene glycol and its derivatives, and polyphioethers as described in U.S. Pat. Nos. 2,533,990, 2,531,832, 2,950,970 and 2,577,127, and Japanese Patent Publication No. 9304/69, and thioether compounds as described in U.S. Pat. No. 3,201,242 can be used.

In addition, sodium sulfite, potassium sulfite, potassium hydrosulfite and sodium hydrosulfite which are commonly used as preservatives can be added.

If desired, the color developer may contain antifoggants. Antifoggants which can be used include alkali metal halides such as potassium bromide, sodium bromide, and potassium iodide, and organic antifoggants. Typical examples of such organic antifoggants are nitrogen-containing heterocyclic compounds such as benzotoiazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, and hydroxyazaindolidine, mercaptosubstituted heterocyclic compounds such as 1-phenyl-5-mercaptotetrazole, 2-mercaptobenzimidazole, and 2-mercaptobenzothiazole, and mercapto-substituted aromatic compounds such as thiosalicylic acid. Particularly preferred are nitrogen-ccntaining heterocyclic compounds. These antifoggants may elute from the color photographic light-sensitive material and accumulate in the color developer during the processing.

The bleaching solution or bleach-fixer which is used in the present invention contains iron complexes as bleaching agents. Of these iron complexes, an aminopolycarboxylic acid/iron complex is preferably used. The amount of the iron complex added is from about 0.01 to 1.0 mol/l and preferably from about 0.05 to 0.50 mol/l.

The fixer or bleach-fixer contains thiosulfates as fixing agents. Of these salts, ammonium thiosulfate is preferably used. The amount of the thiosulfate added is from about 0.1 to 5.0 mol/( and preferably from about 0.5 to 2.0 mol/l.

As preservatives, sulfites are commonly added to the fixer or bleach-fixer. In addition, ascorbic acid, carbonyl bisulfite adducts, and carbonyl compounds may be added. If desired, buffers, brightening agents, chelating agents and biocides can be added, as well as other conventional additives.

As accelerators for the bleaching solution and bleach-fixer, as well as bromine and iodine ions, thiourea compounds described in U.S. Pat. No. 3,706,561, Japanese Patent Publication Nos. 8506/70, 26586/74, Japanese Patent Application (OPI) Nos. 32735/78, 36233/78 and 37016/78, thiol compounds described in Japanese Patent Applicatcn (OPI) Nos. 124424/78, 95631/78, 57831/78, 32736/78, 65732/78, 52534/79 and U.S. Pat. No. 3,893,858, heterocyclic compounds described in Japanese Patent Application (OPI) Nos. 59644/74, 140129/75, 28426/78, 141623/78, 104232/78, 35727/79, and Research Disclosure, No. 17128, thioether compounds as described in Japanese Patent Application (OPI) Nos. 94927/78, 20832/77, 37418/78, 95630/78, 25064/80 and 26506/80, quaternary amines described in Japanese Patent Application (OPI) No. 84440/83, and thiocarbamoyls described in Japanese Patent Application (OPI) No. 42349/74 may be used.

After the washing step in the method of the present invention, if desired, a stabilization bath may be provided. As a stabilizer to be used in the stabilization bath, a solution to stabilize dye images is used. For example, a solution having a pH of about 3 to 6 and a buffering capability, and a solution containing aldehydes (e.g., formaldehyde) can be used. To the stabilizer can be added, if desired, brightening agents, chelating agents, biocides, hardening agents, surface active agents, and so forth.

The stabilization bath may be contained in two or more vessels, if necessary. The amount of the stabilizer used can be reduced by employing multistage countercurrent stabilization (using, for example, 2 to 9 vessels).

The present invention is described in greater detail with reference to the following examples.

EXAMPLE 1

A color negative film HR-100 produced by Fuji Photo Film Co., Ltd. (24 shots) was imagewise exposed and then continuously processed according to the sequence shown below by the use of Fuji Color Negative Processor FP-500 produced by Fuji Photo Film Co., Ltd.

| Step | Time | Temperature | Tank Capacity (l) | Amount Replenished (ml/roll) |
|---|---|---|---|---|
| Color Development | 3 min 15 sec | 38° C. ± 0.3° C. | 21 | 45 |
| Bleaching | 4 min 20 sec | 38° C. ± 3° C. | 18 | 20 |
| Fixing | 3 min 15 sec | 38° C. ± 3° C. | 18 | 39 |
| Washing (1) | 1 min 30 sec | 33° C. ± 3° C. | 8 | — |
| Washing (2) | 2 min | 33° C. ± 3° C. | 8 | 20 |

-continued

| Step | Time | Temperature | Tank Capacity (l) | Amount Replenished (ml/roll) |
|---|---|---|---|---|
| Stabilization | 40 sec | 38° C. ± 3° C. | 13 | 39 |

The washing water was returned from washing step (2) to washing step (1); that is, the washing was carried out using a two-stage countercurrent washing process.

The amount of the processing solution carried over into each vessel from the preceding vessel was about 2 ml per one roll of the 24 shot film.

The compositions of the liquids in the vessels or tanks and of the replenisher liquids added to the tanks are shown below.

| Color Developer | Tank Liquid | Replenisher Liquid |
|---|---|---|
| Sodium Nitrilotriacetate | 1.0 g | 1.1 g |
| Sodium Sulfide | 4 0 g | 4.4 g |
| Sodium Carbonate | 30.0 g | 32.0 g |
| Potassium Bromide | 1.4 g | 0.7 g |
| Hydroxylamine Sulfate | 2.4 g | 2.6 g |
| 4-(N-Ethyl-N-β-hydroxyethyl-amino)-2-methylaniline Sulfate | 4.5 g | 5.0 g |
| Water to make | 1 l | 1 l |
| pH | 10.0 | 10.05 |

| Bleaching Solution | Tank Liquid | Replenisher Liquid |
|---|---|---|
| Ammonium Broide | 160.0 g | 176 g |
| Ammonia Water (28%) | 25.0 g | . 15 g |
| Sodium Iron Ethylenediamine-tetraacetate | 130.0 g | 143 g |
| Glacial Acetic Acid | 14.0 ml | 14.0 ml |
| Water to make | 1 l | 1 l |
| pH | 6.0 | 5.7 |

| Fixer | Tank Liquid | Replenisher Liquid |
|---|---|---|
| Sodium Tetrapolyphosphate | 2.0 g | 2.2 g |
| Sodium Sulfite | 4.0 g | 4.4 g |
| Ammonium Thiosulfate (70%) | 175.0 ml | 193.0 ml |
| Sodium Bisulfite | 4.6 g | 5.1 g |
| Water to make | 1 l | 1 l |
| pH | 6.6 | 6.6 |

| Stabilizer | Tank Liquid | Replenisher Liquid |
|---|---|---|
| Formaldehyde (35%) | 8.0 ml | 8.0 ml |
| Fuji Driwel (produced by Fuji Photo Film Co., Ltd.) | 4.0 ml | 4.0 ml |
| Water to make | 1 l | 1 l |

Under the above described conditions, 40 rolls of color negative films per day were processed, and this processing was continued for 30 days. The number of days until floating matter and precipitates appeared in the washing tanks (1) and (2) was measured, and the results are shown in Table 1. Also, the results obtained when the same processing as above was conducted except that various compounds were added to the washing water (tank liquid or replenisher liquid) are shown in Table 1. The symbol o in Table 1 means that even after the 30 day processing, neither floating matter nor precipitate was formed.

TABLE 1

| Run No. | Washing Conditions: Compound Added: Type | Amount (mol/l) | pH of Washing Water* | Remarks | Washing Step (1) (days) | Washing Step (2) (days) |
|---|---|---|---|---|---|---|
| 1 | — | — | 7.0 | Comparative Example | 14 | 7 |
| 2 | Disodium Ethylenediaminetetra-acetate | $5 \times 10^{-4}$ | " | Comparative Example | 21 | 10 |
| 3 | 1-Hydroxyethylidene-1,1-diphosphonic Acid | " | " | Comparative Example (Compound 1)* | o | 22 |
| 4 | Pentasodium triethylenetetra-aminepentaacetate | " | " | Comparative Example (Compound 2)* | o | 20 |
| 5 | 5-Chloro-2-methyl-4-iso-thiazolin-3-one | " | " | Comparative Example (Compound 3)* | o | 25 |
| 6 | Sodium Dehydroacetate | " | " | Comparative Example | 20 | 11 |
| 7 | 2-(4-Thiazolyl)benzimidazole | $1 \times 10^{-4}$ | " | Comparative Example (Compound 4)* | 23 | 11 |
| 8 | Compound (I-2) of the Invention | $5 \times 10^{-4}$ | " | Method of the Invention | o | o |
| 9 | Compound (I-2) of the Invention | " | " | Method of the Invention | o | o |
| | 5-Chloro-2-methyl-4-iso- | " | | | | |

TABLE 1-continued

| Run No. | Washing Conditions: Compound Added: Type | Amount (mol/l) | pH of Washing Water* | Remarks | Washing Step (1) (days) | Washing Step (2) (days) |
|---|---|---|---|---|---|---|
| | thiazoline-3-one | | | | | |

Note:
pH of washing water: adjusted with KOH and $H_2SO_4$.
Compound 1: Compound shown in Japanese Patent Application (OPI) No. 8543/82
Compound 2: Compound shown in Japanese Patent Application (OPI) No. 132146/82
Compound 3: Compound shown in Japanese Patent Application (OPI) No. 8542/82
Compound 4: Compound shown in Japanese Patent Application (OPI) No. 157244/82

In accordance with the method of the present invention (Run Nos. 8 and 9), the washing water is greatly increased in stability, and the formation of precipitates and floating matter did not occur in either of the washing steps (1) or (2) during the processing.

EXAMPLE 2

A color paper produced by Fuji Photo Film Co., Ltd. was imagewise exposed and then continuously processed by the use of Fuji Color Paper Processor FMPP-1000 (produced by Fuji Photo Film Co., Ltd.) according to the following sequence.

| Step | Time | Temperature | Tank Capacity (l) | Amount Replenished (ml/m$^2$) |
|---|---|---|---|---|
| Color Development | 3 min 30 sec | 38° C. ± 0.3° C. | 88 | 161 |
| Bleach-Fixing | 1 min 30 sec | 33° C. ± 3° C. | 35 | 60 |
| Washing (1) | 40 sec | 33° C. ± 3° C. | 17 | — |
| Washing (2) | 40 sec | 33° C. ± 3° C. | 17 | — |
| Washing (3) | 40 sec | 33° C. ± 3° C. | 17 | 250 |

The washing water was returned from washing step (3) through washing step (2) to washing step (1); that is, the washing was carried out using a three-stage countercurrent washing process.

The amount of the processing solution carried over into each vessel from the preceding vessel was about 60 ml per square meter of the color paper.

The compositions of the liquids in the tanks and of the replenisher liquids are shown below.

| Color Developer | Tank Liquid | Replenisher Liquid |
|---|---|---|
| Water | 800 ml | 800 ml |
| Trisodium Nitrilotriacetate | 2.0 g | 2.0 g |
| Benzyl Alcohol | 14 ml | 18 ml |
| Diethylene Glycol | 10 ml | 10 ml |
| Sodium Sulfite | 2.0 g | 2.5 g |
| Hydroxylamine Sulfate | 3.0 g | 3.5 g |
| Potassium Bromide | 1.0 g | — |
| Sodium Carbonate | 30 g | 35 g |

-continued

| Color Developer | Tank Liquid | Replenisher Liquid |
|---|---|---|
| N-Ethyl-N-(β-methanesulfonamidoethyl)-3-methyl-4-aminoaniline Sulfate | 5.0 g | 8.0 g |
| Water to make | 1,000 ml | 1,000 ml |
| pH | 10.15 | 10.65 |

| Bleach-Fixer | Tank Liquid | Replenisher Liquid |
|---|---|---|
| Water | 400 ml | 400 ml |
| Ammonium Thiosulfate (70% scln.) | 150 ml | 300 ml |
| Sodium Sulfate | 18 g | 36 g |
| Iron (III) Ammonium Ethylenediaminetetraacetate | 55 g | 110 g |
| Disodium Ethylenediaminetetraacetate | 5 g | 10 g |
| Water to make | 1,000 ml | 1,000 ml |
| pH | 6.70 | 6.50 |

Under the above described conditions, 10 m$^2$ of the color paper per day was processed, and this processing was continued for 30 days. The number of days until floating matter and precipitates were formed in the washing tanks (1), (2) and (3) was measured, and the results are shown in Table 2. Also, the results obtained when the same processing as above was conducted except that various compounds were added to the washing water (tank liquid and replenisher liquid) are shown in Table 2. The symbol o is the same as defined in Example 1.

TABLE 2

| Run No. | Washing Conditions: Compound Added: Type | Amount (mol/l) | pH of Washing Water* | Remarks | Washing Step (1) (days) | Washing Step (2) (days) | Washing Step (3) (days) |
|---|---|---|---|---|---|---|---|
| 10 | — | — | 7.0 | Comparative Example | 16 | 10 | 5 |
| 11 | Disodium Ethylenediaminetetraacetate | $5 \times 10^{-3}$ | " | Comparative Example | 21 | 12 | 8 |
| 12 | 1-Hydroxyethylidene-1,1-disulfonic Acid | " | " | Comparative Example (Compund 1)* | o | 25 | 18 |
| 13 | Hexasodium Hexamethylenepentaaminehexaacetate | " | " | Comparative Example | o | 20 | 15 |

TABLE 2-continued

| Run No. | Washing Conditions: Compound Added: Type | Amount (mol/l) | pH of Washing Water* | Remarks | Washing Step (1) (days) | Washing Step (2) (days) | Washing Step (3) (days) |
|---|---|---|---|---|---|---|---|
| 14 | Potassium Sorbicate | " | " | (Compound 2)* Comparative Example | 16 | 10 | 6 |
| 15 | 5-Chloro-2-methyl-4-isothiazoline-3-one | " | " | (Compound 2)* Comparative Example | o | o | 21 |
| 16 | 2-(4-thiazolyl)benz-imidazole | $1 \times 10^{-4}$ | " | (Compound 3)* Comparative Example | o | 19 | 15 |
| 17 | Compound (I-2) of the Invention | $5 \times 10^{-3}$ | " | (Compound 4)* Method of the Invention | o | o | o |
| 18 | Compound (I-2) of the Invention<br>5-Chloro-2-methyl-4-isothiazolin-3-one | "<br>$5 \times 10^{-4}$ | " | Method of the Invention | o | o | o |

Note:
pH of washing water: Adjusted with KOH and $H_2SO_4$.
Compound 1: Compound described in Japanese Patent Application (OPI) No. 8543/82
Compound 2: Compound described in Japanese Patent Application (OPI) No. 132146/82
Compound 3: Compound described in Japanese Patent Application (OPI) No. 8542/82
Compound 4: Compound described in Japanese Patent Application (OPI) No. 157244/82

In accordance with the method of the present invention, not only in the washing steps (1) and (2) but also in the washing step (3) where precipitates and floating matter are likely to be formed, neither precipitates nor floating matter were formed during the 30 day processing.

EXAMPLE 3

A color paper produced by Fuji Photo Film Co., Ltd. was imagewise exposed and then continuously processed in the same manner as in Run No. 10 of Example 2 except for increasing the amount replenished to a standard amount of 10,000 ml/m$^2$ with respect to washing condition. This is designated as Run No. 19.

An unexposed color paper produced by Fuji Photo Film Co., Ltd. was processed in the same manner as in Run No. 10, 17 or 19 of Example 2, after the exposed color paper was continuously processed in the same manner as in Run No. 10, 17 or 19 of Example 2, respectively.

Each processed color paper was allowed to stand under the condition of 60° C. and 70% RH for 8 weeks and then was measured in increase of yellow density ($\Delta^{D}_{Bmin}$) by means of Macbeth densitometer. The results are shown in Table 3.

TABLE 3

| Run No. | $\Delta D_{Bmin}$ | Remarks |
|---|---|---|
| 10 | +0.40 | Comparison |
| 17 | +0.09 | The Invention |
| 19 | +0.10 | Comparison |

According to the Comparison (Run No. 10), when the amount replenished was simply decreased, the deterioration in yellow stain remarkably occurred. However, according to the present invention (Run No. 17), the occurrence of yellow stain was not inferior to that of the comparison (Run No. 19).

While the invention has been described in detail and with reference to specific embodiments thereof, it will be apparent to one skilled in the art that various changes and modifications can be made therein without departing from the spirit and scope thereof.

What is claimed is:

1. A method of continuously processing an imagewise exposed silver halide color photographic light-sensitive material comprising the steps of (a) developing the exposed material, (b) bleaching and fixing the developed material or bleach-fixing the material and then (c) washing the material with a composition consisting essentially of (1) water, (2) at least one compound represented by general formula (I):

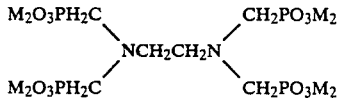

(I)

wherein M is a hydrogen atom, a lithium atom, a sodium atom, a potassium atom, or an ammonium ion and each M may be the same or different, (3) an iron salt in an amount of from about $1\times10^{-6}$ to $1\times10^{-1}$ mol/l of said water, and (4) a thiosulfate in an amount of from $1\times10^{-4}$ to $5\times10^{-1}$ mol/l of said water, wherein at least a part of the iron salt and the thiosulfate are carried into the composition for washing the material from preceding baths in the method of continuously processing the imagewise exposed silver halide color photographic light-sensitive material and wherein the iron salt is a bleaching agent and the thiosulfate is a fixing agent used as the bleaching agent and fixing agent, respectively, in step (b).

2. The method as claimed is claim 1, wherein said compound represented by general formula (I) is selected from the group consisting of the following compounds (I-1), (I-2) and (I-3):

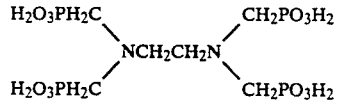

I-1

-continued

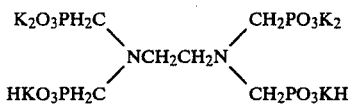

I-2

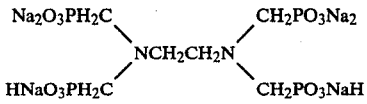

I-3

3. The method as claimed in claim 1, wherein the compound represented by general formula (I) is present in an amount of from about $1\times10^{-5}$ to 1.0 mol per liter of water in said washing step.

4. The method as claimed in claim 3, wherein the compound represented by general formula (I) is present in an amount of from about $1\times10^{-4}$ to $2\times10^{-2}$ mol per liter of water in said washing step.

5. The method as claimed in claim 1, wherein said water contains an iron salt in an amount of from about $1\times10^{-5}$ to $5\times10^{-2}$ mol/l of said water and a thiosulfate in an amount of from about $1\times10^{-3}$ to $3\times10^{-1}$ mol/l of said water.

6. A method of continuously processing an imagewise exposed silver halide color photographic light-sensitive material comprising the steps of (a) developing the exposed material, (b) bleaching and fixing the developed material or bleach-fixing the material and then (c) washing the material with a composition consisting essentially of (1) water, (2) at least one compound represented by general formula (I):

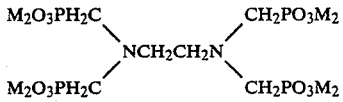

(I)

wherein M is a hydrogen atom, a lithium atom, a sodium atom, a potassium atom, or an ammonium ion and each M may be the same or different, (3) an iron salt in an amount of from about $1\times10^{-6}$ to $1\times10^{-1}$ mol/l of said water, (4) a thiosulfate in an amount of from $1\times10^{-4}$ to $5\times10^{-1}$ mol/l of said water, and (5) biocides wherein at least a part of the iron salt and the thiosulfate are carried into the composition for washing the material from preceding baths in the method of continuously processing the imagewise exposed silver halide color photographic light-sensitive material and wherein the iron salt is a bleaching agent and the thiosulfate is a fixing agent used as the bleaching agent and fixing agent, respectively, in step (b).

* * * * *